US007793865B2

(12) United States Patent
Ginther

(10) Patent No.: US 7,793,865 B2
(45) Date of Patent: Sep. 14, 2010

(54) ANTIFREEZE FOAM INJECTION SYSTEM

(76) Inventor: Jeromy Ginther, 4499 Rabbit Run La., Loveland, CO (US) 80537

( * ) Notice: Subject to any disclaimer, the term of this patent is extended or adjusted under 35 U.S.C. 154(b) by 75 days.

(21) Appl. No.: 11/843,505

(22) Filed: Aug. 22, 2007

(65) Prior Publication Data

US 2008/0083837 A1 Apr. 10, 2008

Related U.S. Application Data

(60) Provisional application No. 60/823,225, filed on Aug. 22, 2006.

(51) Int. Cl.
*A62C 5/02* (2006.01)
*B05B 11/06* (2006.01)
*A61M 11/02* (2006.01)

(52) U.S. Cl. ..... 239/310; 239/8; 239/9; 239/362; 239/369

(58) Field of Classification Search ..... 239/8, 239/9, 225, 337, 362–363, 351, 369; 169/5, 169/8, 9, 18
See application file for complete search history.

(56) References Cited

U.S. PATENT DOCUMENTS 3,384,123 A 5/1968 Saddison et al.
3,986,523 A * 10/1976 Pacht ..... 137/882
4,006,703 A * 2/1977 Smith ..... 118/685
5,488,968 A * 2/1996 Price et al. ..... 137/1
5,595,788 A * 1/1997 Lott et al. ..... 427/156
5,904,297 A * 5/1999 Kendrick et al. ..... 239/124
5,959,788 A * 9/1999 Yamakawa et al. ..... 359/760
6,138,926 A * 10/2000 Russo ..... 239/310
6,155,351 A * 12/2000 Breedlove et al. ..... 169/14
6,276,459 B1 * 8/2001 Herrick et al. ..... 169/14
6,422,734 B1 * 7/2002 Sethuraman et al. ..... 366/101
RE37,830 E * 9/2002 Chase ..... 118/680
7,165,627 B2 * 1/2007 Hutter et al. ..... 169/53
7,404,917 B2 * 7/2008 Gannaway et al. ..... 264/42
7,451,900 B2 * 11/2008 Hornsby et al. ..... 222/325
2007/0267512 A1 * 11/2007 Raabe ..... 239/9

* cited by examiner

*Primary Examiner*—Dinh Q Nguyen
*Assistant Examiner*—Justin Jonaitis
(74) *Attorney, Agent, or Firm*—Faegre & Benson LLP

(57) ABSTRACT

Systems according to embodiments of the present invention include an antifreeze manifold carrying pressurized antifreeze liquid, the pressurized antifreeze liquid having a foam surfactant, an air manifold carrying pressurized air, a junction of the antifreeze manifold and the air manifold, the junction configured to combine the pressurized antifreeze liquid and the pressurized air to form antifreeze foam, a foam generator configured to enhance bubble formation, and an outlet conduit to receive the foam. Methods according to embodiments of the present invention include storing an antifreeze liquid having a foam surfactant, pressurizing the antifreeze liquid to a first pressure, pressurizing a gas to a second pressure, wherein the second pressure is different from the first pressure, combining the antifreeze liquid at the first pressure with the gas at the second pressure to form an antifreeze foam, and injecting the antifreeze foam into a conduit to displace freezable fluid in the conduit.

19 Claims, 4 Drawing Sheets

ANTIFREEZE FOAM INJECTION SYSTEM

CROSS-REFERENCE TO RELATED APPLICATIONS

This application claims the benefit of U.S. Provisional Patent Application Ser. No. 60/823,225, filed on Aug. 22, 2006, and entitled, "Antifreeze Foam Injection System," which is incorporated herein by reference in its entirety for all purposes.

TECHNICAL FIELD

Embodiments of the present invention are related generally to safe, economical, reliable, and environmentally responsible systems and methods for keeping pipelines (also referred to as conduits, lines, hoses, manifolds, etc.), and more importantly the liquid therein, from freezing; and more specifically to systems and methods for injecting antifreeze foam into pipelines.

BACKGROUND

Existing methods for keeping lines unfrozen may include the use of heat tape, recirculating lines, heated lines, weep systems (in which water is run continuously or intermittently through lines), air purge, and/or liquid antifreeze injection. Such methods may serve to prevent freezing of lines, but often suffer from high operating costs, wastefulness, high-energy demand, dangerousness, unreliability, and/or high expense for the related equipment. There exists a need in the art for improved systems and methods for antifreeze foam injection.

SUMMARY

Systems for antifreeze foam injection according to embodiments of the present invention include an antifreeze manifold carrying a pressurized antifreeze liquid, the pressurized antifreeze liquid having a foam surfactant, an air manifold carrying pressurized air; a junction of the antifreeze manifold and the air manifold, the junction configured to combine the pressurized antifreeze liquid and the pressurized air to form antifreeze foam; a foam generator in fluid communication with the junction, the foam generator configured to enhance bubble formation of the antifreeze foam, and an outlet conduit configured to receive the antifreeze foam. Such embodiments of systems may further include a container of the antifreeze liquid, an air compressor configured to create the pressurized air, a diaphragm pump actuated by the pressurized air of the air compressor, the diaphragm pump operable to pump from the container to create the pressurized antifreeze liquid, first air pressure regulator upstream of the diaphragm pump, the first regulator configured to regulate the pressurized antifreeze liquid to a first pressure, and a second air pressure regulator downstream from the air compressor, the second air pressure regulator configured to regulate the pressurized air to a second pressure.

According to some embodiments, the system may further include a first solenoid valve configured to control flow of the pressurized antifreeze liquid to the antifreeze manifold, and a second solenoid valve configured to control flow of the pressurized air to the air manifold. In some cases, the liquid pressure is higher than the gas pressure. The outlet may include a low pressure outlet and a high pressure outlet; the low pressure outlet may be, for example, a solenoid dump valve. According to some embodiments, the outlet conduit includes a dump gun with a trigger, and activation of the trigger dispenses fluid through the high pressure outlet, and non-activation of the trigger opens the low pressure outlet to facilitate antifreeze foam injection through the conduit. The foam generator may be made by forming a Teflon® mesh within a plastic pipe, for example.

Methods for antifreeze foam injection according to embodiments of the present invention include storing an antifreeze liquid having a foam surfactant, pressurizing the antifreeze liquid to a first pressure, pressurizing a gas to a second pressure, wherein the second pressure is different from the first pressure, combining the antifreeze liquid at the first pressure with the gas at the second pressure to form an antifreeze foam, and injecting the antifreeze foam into a conduit to displace freezable fluid in the conduit. In some cases, the second pressure is less than the first pressure. According to some embodiments, the gas is air, the first pressure is approximately fifty pounds per square inch, and the second pressure is approximately forty pounds per square inch. In addition, a foam generator may be used to combine the antifreeze liquid with the gas to enhance bubble protection. In some embodiments, the antifreeze liquid is approximately six hundred forty parts water, one hundred twenty-eight parts methanol, and one part foam surfactant.

An electronic control unit may be employed to monitor an ambient temperature near the conduit, and then initiate injection of the antifreeze foam into the conduit when the ambient temperature reaches a temperature at which the freezable fluid in the conduit freezes. In other embodiments, the electronic control unit monitors whether the conduit is being used to dispense the freezable fluid, and then initiates injection of the antifreeze foam into the conduit when the conduit is no longer being used to dispense the freezable fluid.

Methods for antifreeze foam injection in an automatic or self-service car wash bay according to embodiments of the present invention may include storing an antifreeze liquid having a foam surfactant, pressurizing the antifreeze liquid to a first pressure, pressurizing air to a second pressure, wherein the second pressure is smaller than the first pressure, combining the antifreeze liquid at the first pressure with the air at the second pressure to form an antifreeze foam mixture, directing the antifreeze foam mixture through a foam generator to enhance bubble production, opening a low pressure outlet in a carwash bay conduit, and injecting the antifreeze foam mixture into the carwash bay conduit. According to some embodiments of the present invention, injecting the antifreeze foam mixture into the carwash bay conduit includes displacing freezable fluid in the conduit with the antifreeze foam mixture. The carwash bay conduit may terminate at a dump gun, such that opening the low pressure outlet includes releasing a trigger of the dump gun. Alternatively, the carwash bay conduit may terminate at an automatic carwash panel, such that opening the low pressure outlet includes opening a dump solenoid valve.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
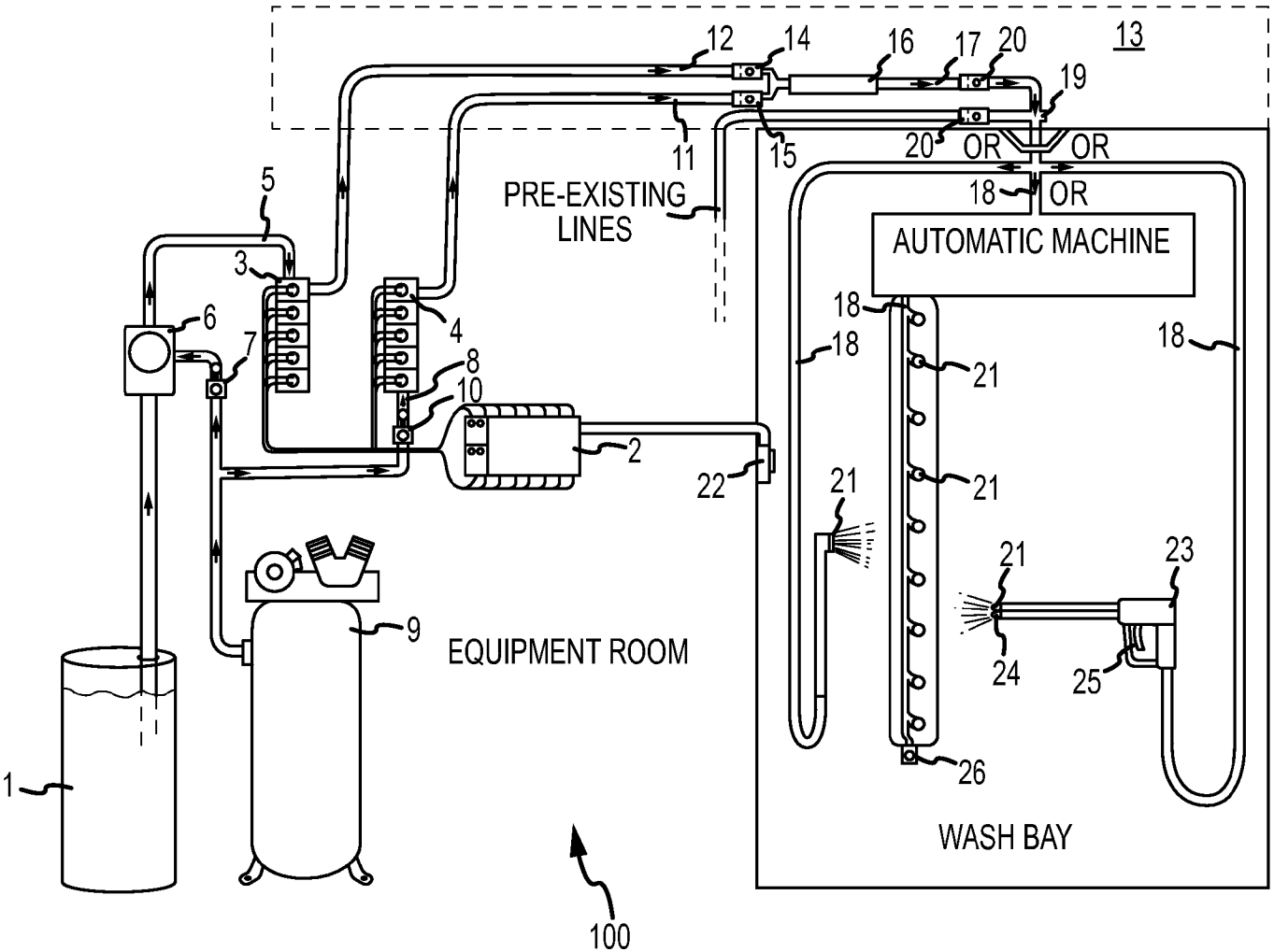
FIG. 1 illustrates an antifreeze foam injection system according to embodiments of the present invention.
Figure 2:
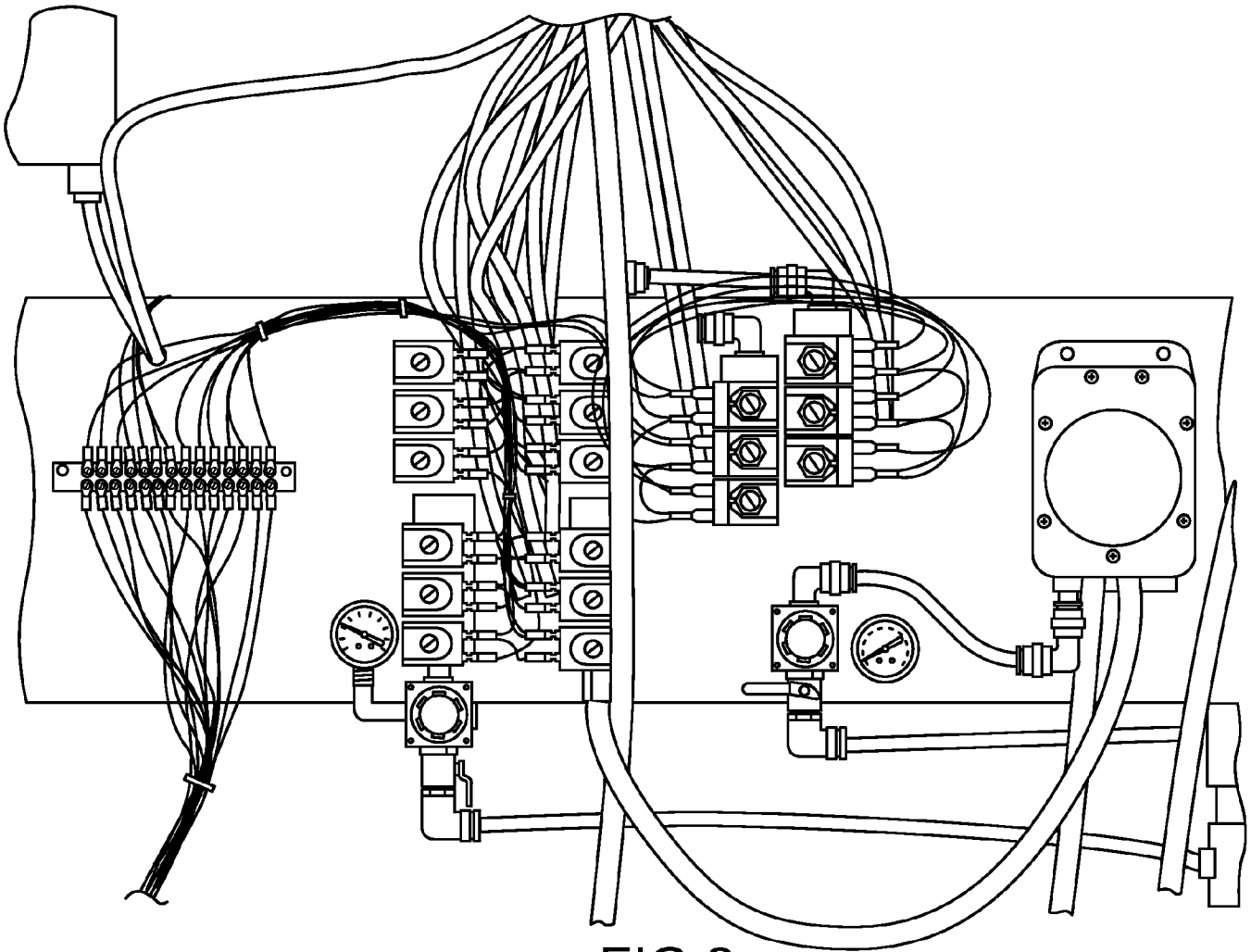
FIG. 2 depicts a solenoid valve assembly for use with an antifreeze foam injection system according to embodiments of the present invention.
Figure 3:
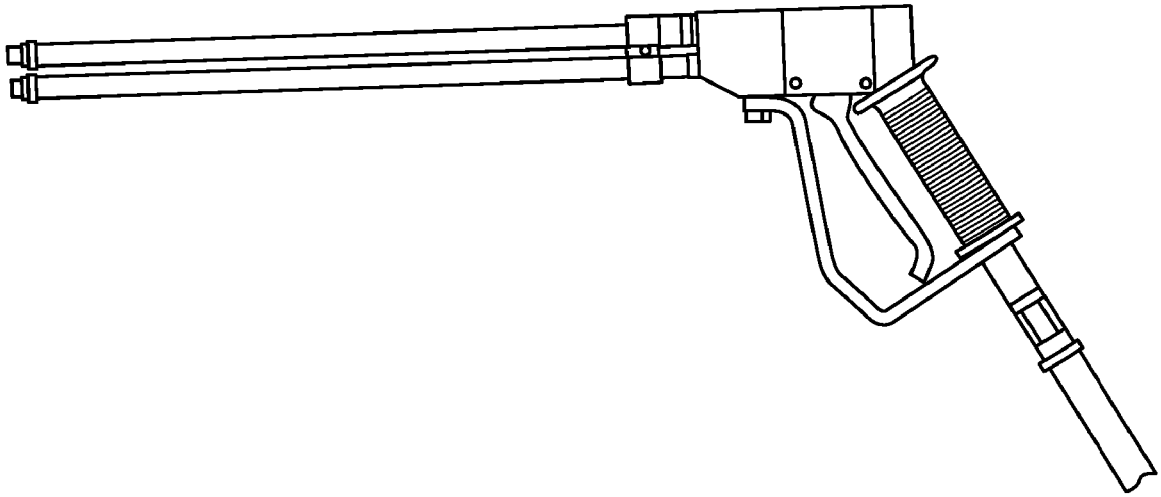
FIG. 3 depicts an exemplary dual-outlet dump gun, according to embodiments of the present invention.
Figure 4:
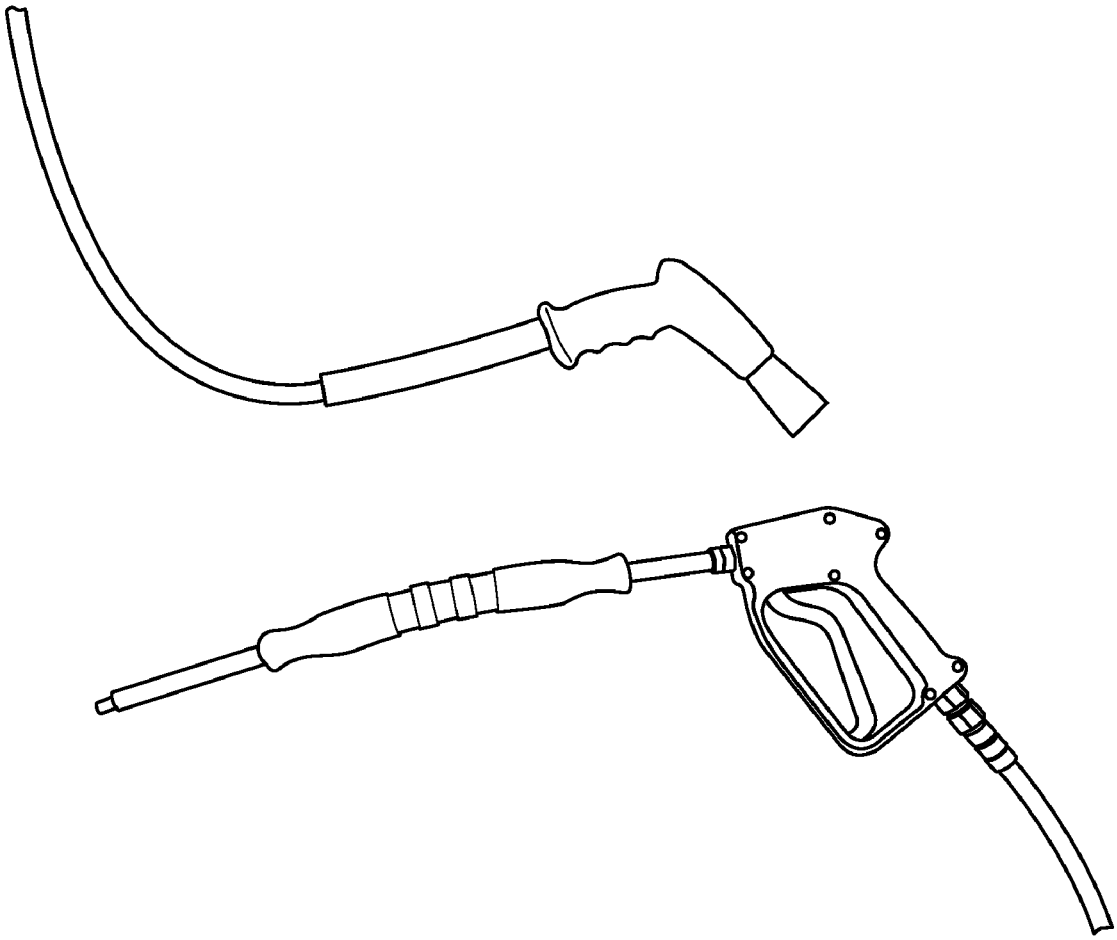
FIG. 4 depicts an example of a low-pressure foam/fluid applicator wand and a high-pressure fluid discharge wand, according to embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments of the present invention may be employed with nearly any existing system where pipes are exposed to freezing conditions. For example, embodiments of the present invention may be used to freeze protect pipelines used in the car washing industry (self-service or automated type). Car washes typically have hoses in the bays that feed pressure guns (or wands), foam brushes, applicator guns, tire brushes, automatic car wash equipment, and so forth. Of course, in the event of freezing temperatures, the lines will freeze, causing shut downs, and often time-consuming and expensive repairs.

Embodiments of the present invention, in most basic terms, constitute an antifreeze foam injection system. Embodiments of such a system purge freezable liquid from the line by displacing the liquid with a pressurized timed output of antifreeze bubbles. FIG. 1 visually displays how an embodiment of such a system works. The following is a step-by-step description referencing the antifreeze foam injection system 100 of FIG. 1.

To begin with, the antifreeze foam (AFF) does not start out as foam, according to embodiments of the present invention. An antifreeze mixture (for example: 640 parts water, 128 parts methanol, 1 part foam additive surfactant designed to be miscible with methanol) is either purchased as is or can be blended on-site using conventional methods well known in the art. Alternatively, a mixture of polypropylene glycol may be formulated to create a foam which does not use flammable materials; other chemical formulas may also serve to create a foam with freeze-resistant properties or a lower freezing temperature. This mixture may be stored in a holding tank 1 for future use.

When the temperature drops below freezing, an electronic control unit 2 ("ECU"), using a temperature sensor, may begin operation. The ECU 2 will wait a preset amount of time before initiating line purge. Once the preset amount of time has been reached, the ECU 2 may begin to systematically (depending on quantity and size of lines) purge the lines of freezable liquids by deploying AFF through the lines. The ECU 2 may be programmed to recognize that a line is currently in use, and to wait to purge that particular line until the line is no longer being used. Whenever a line is being used (i.e. a customer is washing a car), the ECU 2 notes which of the lines is being used and, after a preset amount of time after a line is no longer being used, may proceed to purge with AFF only the line or lines that were previously being used during the automatic and/or systematic purging. Whenever a facility is used (i.e. a customer is washing a car), the ECU 2 notes which lines are being used, waits a preset amount of time after a line is used, then proceeds to purge with AFF only the line or lines that were being used, according to embodiments of the present invention. The ECU 2 may also be programmed to remember whether a line is filled with AFF even if the temperature goes above freezing and back below again, such that the ECU 2 is programmed to refrain from purging a line that already contains AFF.

In order to fill the lines with a pressurized and timed output of AFF, the ECU 2 may open both a liquid solenoid valve 3 and an air solenoid valve 4. The liquid solenoid valve 3 is fed by a pressurized manifold 5 (which may be pressurized by an air operated diaphragm pump 6) and employs a regulated and adjustable pressure setting 7 (which, for example, may be set at 50 psi—depending on many site specific factors). Air solenoid valve 4 may be fed by a pressurized manifold 8 (which may be connected to an air compressor tank 9), which may also employ a regulated and adjustable pressure setting 10 (typically set at 40 psi, but also may depend on many site specific factors). Site specific factors which may influence the desired pressure settings for pressure setting 7 and/or pressure setting 10 may include, but are not limited to, the type of equipment being purged, orifice (tip) size, service tubing size, chemical makeup of AFF ingredients, whether a foam generator 16 is used, cracking pressure of check valves used, and/or the hardness of water on site. Beneficial settings for pressure settings 7, 10 may be located during a test activation as part of initial installation and/or periodic maintenance. During such testing, both pressure regulators 7, 10 may be adjusted to maximize beneficial foaming properties, similar to the way in which standard car wash equipment is installed and/or tested. A pressure setting of 50 psi for regulator 7 and a pressure setting of 40 psi for regulator 10 have been found to work effectively to create AFF for a particular installed car wash system.

Antifreeze foam may be made effectively by using a surfactant that lowers the surface tension of the antifreeze/water mixture to a point at which the final chemical will "bubble" effectively by mixing together with pressurized air. Injecting air into a stream of "soapy" (high in surfactant) water causes bubbles to form, according to embodiments of the present invention. Although foam generator 16 is not necessary for the creation of antifreeze foam according to embodiments of the present invention, the foam generator 16 enhances the bubbling effect and bubble sizing so as to reduce the amount of chemical required and to maximize the amount of displacement capability of the antifreeze foam. According to embodiments of the present invention, foam generator 16 may be constructed of a twelve-inch length of one and one-half inch Schedule 80 PVC pipe housing with reducing bushings on either end for the housing. Inside the PVC pipe, a portion of a Teflon® (for chemical stability) scouring pad (e.g. those available at a local grocery store) may be formed and/or mounted therein. A crossbar may be employed at the end of the generator 16 to prevent unwanted shards of the Teflon material from passing downstream, according to embodiments of the present invention.

The outlets of solenoid valves 3, 4 may be plumbed to manifolds 12, 11 respectively; manifolds 11, 12, may ideally be placed as close as possible to where the exposed freezing line is protected from outside elements (typically inside a heated equipment room, or preferably in a freeze-protected trough 13 designed to house feed lines along the roof/ceiling and terminating above the bays). At this point, both the pressurized liquid and air combine in a "T" junction. Both lines 11, 12 should be connected to check valves 14, 15 to prevent unwanted backflow, according to embodiments of the present invention. When the air and liquid mixes at the correct pressures, bubbles will naturally form. According to some embodiments of the present invention, AFF creation may be optimized by using a liquid pressure (set by regulator 7) that is higher than an air pressure (set by regulator 10). This bubbling may be maximized by optionally using a foam generator 16 in fluid communication with the "T" junction; foam generator 16 may be a conduit with a stainless or similar mesh enclosed, for example. Finally, the line 17 coming out of the foam generator 16 is connected to the operating line 18 which is to be purged; such a connection may be accomplished with a T-joint 19, for example. As used herein, the phrase "in fluid communication" is used in its broadest sense to refer to elements between or through which fluid may flow, either directly or indirectly.

Ideally, a backpressure check valve 20 may be used before this junction 19 to protect the entire system 100 and/or foam generator 16 from backflow and high pressures. The generated AFF flows through the line 18 to the outlet 21. According to some embodiments of the present invention, the ECU 2 may be programmed to open the solenoids 3, 4 only long enough for the AFF to entirely displace the freezable liquid in the line 18. The ECU 2 may then close the solenoids and wait for a line to be used again. Based on the disclosure provided herein, one of ordinary skill in the art will appreciate the various ways in which the ECU 2 and/or related sensors 22 may be wired and/or programmed to perform the various monitoring and/or control functions described herein.

The following exemplary decision process illustrates logic which may be programmed into the ECU, according to embodiments of the present invention:

Step One—Is the temperature below freezing? If no, repeat Step One (redundant check for change in temperature). If yes, proceed to Step Two.

Step Two—Is antifreeze currently in the line (as opposed to an environmentally freezable liquid)? If no, proceed to Step Three. If yes, revert back to Step One.

Step Three—Is the line currently in use (water or chemical flowing through it)? If no, proceed to Step Four. If yes, wait until line is no longer in use, then proceed to Step Four.

Step Four—Wait for user-definable time period delay (site specific estimation necessary—testing successful in Colorado at 60 seconds). After successful delay, proceed to Step Five. If line is used again during delay period, revert back to Step Three.

Step Five—Open air and antifreeze solenoids for user-definable time period (dependent on length of line/conduit which antifreeze foam must travel though—testing successful in Colorado at one location at 7 seconds). If line becomes in use, close solenoids and revert back to Step Three. If allowed to flow for user definable time period without interruption, the line is freeze protected—revert back to Step One.

Step Six—Repeat as necessary for all lines to be protected at all times in a redundant fashion.

Based on the disclosure provided herein, one of ordinary skill in the art will appreciate that additional features may be programmed into the ECU 2 in order to further enhance efficiency of operation. For example, under freezing conditions, a line start-up delay (user definable—testing successful at 3 seconds) can be programmed in such a way that the system will not permit any freezable fluids to flow unless the operator has chosen to wait during the aforementioned delay, according to embodiments of the present invention. Such a procedure minimizes risk of the lines accidentally filling with freezable liquids, and serves as a verification that the operator has intended to use the line even though the environment will cause a freezing condition, according to embodiments of the present invention.

Again, lines can feed any number of items or equipment. Typically foam brushes, applicator guns, tire brushes, and/or (in most cases) automated car wash units have a relatively large output orifice, and the foaming characteristics of the AFF may easily be achieved according to embodiments of the present invention. A high-pressure wand, however, may create a high-pressure discharge by forcing a high volume through a very small orifice. Such a configuration may inhibit creation of AFF and/or proper displacement of freezable liquids (as opposed to simply mixing with the freezable liquids). Such an unfavorable configuration may be avoided, however, by using a special type of high-pressure wand. Typically referred to as a "dump gun" 23, this type of pressure gun features two outlets: a high-pressure outlet 24 and a low-pressure outlet 21. When the trigger is not pulled, the low-pressure outlet 21 is open allowing a high volume to easily be pushed through the gun 23, thereby facilitating the easy creation of AFF and the purging of line 18 therewith, while still permitting gun 23 to be used to create a high-pressure discharge through outlet 24 upon activation of the trigger 25.

On high-pressure automated car wash units, a similar problem with volume may be encountered. However, this is also easily circumvented by installing a "dump" solenoid valve 26 with a high-pressure/small orifice state and a low-pressure/large orifice state (or in some embodiments, a completely closed state and a completely open state), which the ECU 2 could open to drain the freezable liquid from the onboard lines and allow the AFF to easily flow. Conversely, some manufacturers already have in place the ability to "blow down" (by forcing high pressure air through the lines) the system; such a configuration may also provide an ideal environment for the AFF to flow and purge the remaining freezable liquid that inevitably settles in the low spots of the lines. According to embodiments of the present invention, creation of AFF and displacement of freezable liquid in the lines by AFF may be maximized by providing a higher-volume outlet from line 18.

Beyond use of embodiments of the present invention for freeze proofing lines, utilizing "dump" technology, such as, for example, dump gun 23 and/or a dump solenoid 26 in line 18, may create several other benefits which may be realized by an operator of system 100. For example, a self-serve dump gun may be used which includes two separate barrels, one barrel including a large orifice type nozzle (i.e. a "4030"-type nozzle). Such a configuration may eliminate the use of much additional hardware often necessary for new features currently popular in the carwash industry. Included among these are foam wax, foam conditioner, foam presoak, foam tire cleaner, foam bug remover, etc. Utilizing this type of gun allows the complete elimination of the low pressure (i.e. foaming gun) and all related hardware—eliminating a source of confusion for some customers. According to such embodiments of the present invention, in addition to facilitating creation and deployment of AFF in line 18 during the non-use foam injection phase, a low pressure outlet 21 of dump gun 23 may be used by a customer to dispense various foam products currently dispensed by an entirely separate piece of hardware in conventional self-serve carwashes. Additionally, proper use of the dump mechanism 23 can eliminate the use of an unloader, allow for low pressure rinsing at high volume, allow for low pressure wax at high volume, and allow for high speed chemical changeover. Such features, singly and/or in combination, may allow for higher wash speeds, higher throughput, and an all around higher quality of service for the customer.

Although some embodiments of the present invention have been described as applicable to conduits in car wash bays, embodiments of the present invention may also be used to inject antifreeze foam into other conduits. For example, plumbing in a house may be winterized using injected antifreeze foam such as, for example, antifreeze foam made with food grade propylene glycol, according to embodiments of the present invention. For injecting antifreeze foam into water pipes in a house, the low pressure outlets (e.g. faucets and spouts) may be opened to facilitate the injection of the antifreeze foam and the volumetric displacement of the freezable fluids with the antifreeze foam, according to embodiments of the present invention.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

I claim:

1. A system for antifreeze foam injection into a carwash bay conduit between uses of the conduit to dispense a freezable fluid in a carwash process, the system comprising:

a container, the container containing a first mixture of antifreeze liquid and a foam surfactant;

an air compressor configured to create pressurized air;

a pump operable to pump the first mixture from the container;

an antifreeze manifold carrying the first mixture;

an air manifold carrying the pressurized air;

a junction of the antifreeze manifold and the air manifold, the junction configured to combine the first mixture and the pressurized air to form a second mixture, wherein the second mixture comprises antifreeze foam; and an outlet conduit configured to receive the second mixture, the outlet conduit including an outlet configured to vent the freezable fluid as the freezable fluid is at least partially displaced from the outlet conduit by the second mixture.

2. The system of claim 1, further comprising a foam generator in fluid communication with the junction, the foam generator configured to enhance bubble formation of the second mixture.

3. The system of claim 2, wherein the foam generator comprises:

a plastic pipe; and a Teflon® mesh formed within the plastic pipe.

4. The system of claim 1, wherein the pump is a diaphragm pump actuated by the pressurized air of the air compressor, the system further comprising:

a first air pressure regulator upstream of the diaphragm pump, the first regulator configured to regulate the first mixture to a first pressure; and a second air pressure regulator downstream from the air compressor, the second air pressure regulator configured to regulate the pressurized air to a second pressure.

5. The system of claim 4, further comprising:

a first solenoid valve configured to control flow of the first mixture to the antifreeze manifold; and a second solenoid valve configured to control flow of the pressurized air to the air manifold.

6. The system of claim 4, wherein the first pressure is larger than the second pressure.

7. The system of claim 1, wherein the outlet is a low pressure outlet, and wherein the outlet conduit further comprises a high pressure outlet.

8. The system of claim 7, wherein the low pressure outlet is a solenoid dump valve.

9. The system of claim 7, wherein the outlet conduit comprises a dump gun having a trigger, wherein activation of the trigger dispenses fluid through the high pressure outlet, and wherein non-activation of the trigger opens the low pressure outlet to facilitate antifreeze foam injection through the conduit.

10. A method for antifreeze foam injection into a carwash bay conduit between uses of the conduit to dispense a freezable fluid in a carwash process, the method comprising:

storing a first mixture of an antifreeze liquid and a foam surfactant;

pressurizing the first mixture to a first pressure;

pressurizing a gas to a second pressure, wherein the second pressure is different from the first pressure;

combining the first mixture at the first pressure with the gas at the second pressure to form a second mixture, the second mixture comprising an antifreeze foam;

monitoring whether the conduit is being used to dispense the freezable fluid; and initiating injection of the second mixture into the conduit to displace the freezable fluid in the conduit when the conduit is no longer being used to dispense the freezable fluid.

11. The method of claim 10, wherein the second pressure is less than the first pressure.

12. The method of claim 11, wherein the gas is air, wherein the first pressure is approximately fifty pounds per square inch, and wherein the second pressure is approximately forty pounds per square inch.

13. The method of claim 10, wherein combining the first mixture with the gas comprises directing the first mixture and the gas through a foam generator to enhance bubble production.

14. The method of claim 10, wherein the first mixture is approximately six hundred forty parts water, one hundred twenty-eight parts methanol, and one part foam surfactant.

15. The method of claim 10, further comprising:

monitoring an ambient temperature near the conduit; and initiating injection of the second mixture into the conduit when the ambient temperature reaches a temperature at which the freezable fluid in the conduit freezes.

16. A method for antifreeze foam injection into a conduit used to transmit freezable fluid during a vehicle wash in an automatic or self-service car wash bay, the method comprising:

storing a first mixture comprising an antifreeze liquid and a foam surfactant;

pressurizing the first mixture to a first pressure;

pressurizing air to a second pressure, wherein the second pressure is smaller than the first pressure;

combining the first mixture at the first pressure with the air at the second pressure to form an antifreeze foam mixture;

directing the antifreeze foam mixture through a foam generator to enhance bubble production;

opening a low pressure outlet in the conduit; and injecting the antifreeze foam mixture into the conduit to at least partially displace the freezable fluid.

17. The method of claim 16, wherein injecting the antifreeze foam mixture into the conduit comprises completely displacing freezable fluid in the conduit with the antifreeze foam mixture.

18. The method of claim 16, wherein the carwash bay conduit terminates at a dump gun, and wherein opening the low pressure outlet comprises releasing a trigger of the dump gun.

19. The method of claim 16, wherein the carwash bay conduit terminates at an automatic carwash panel, and wherein opening the low pressure outlet comprises opening a dump solenoid valve.

* * * * *